US005476026A

United States Patent [19]

McFarlin

[11] Patent Number: 5,476,026

[45] Date of Patent: Dec. 19, 1995

[54] MOUTHPIECE CORRECTION TAB

[76] Inventor: Bill E. McFarlin, Rte. 4, Box 71, Williston, N. Dak. 58801

[21] Appl. No.: 20,737

[22] Filed: Feb. 22, 1993

[51] Int. Cl.[6] ..... G10D 9/02

[52] U.S. Cl. ..... 84/383 R; 84/398

[58] Field of Search ..... 84/383 R, 398, 84/383 A

[56] References Cited

U.S. PATENT DOCUMENTS

| | | | |
|---|---|---|---|
| 1,506,364 | 8/1924 | Chiron et al. | 84/383 R |
| 1,562,038 | 7/1925 | Neumann | 84/383 R |
| 2,296,737 | 9/1942 | Peterson | 84/383 R |
| 4,212,223 | 7/1980 | Runyon | 84/383 R |
| 4,372,190 | 2/1983 | McGuerty | 84/383 R |

*Primary Examiner*—Patrick J. Stanzione
*Attorney, Agent, or Firm*—Curtis V. Harr

[57] ABSTRACT

A reed instrument mouthpiece with an adhesive backed tab to be placed on the upper surface of the mouthpiece. The elongated tab has an indented line, groove or slot on the breadth of its surface. The line, groove or slot provides the player with the proper distance to place the mouthpiece in his or her mouth by placing the teeth on the indented line, groove or slot. The lines, grooves or slots may be placed at different intervals and the tab would be fitted flush with the blowing end or tip of the mouthpiece. An indented line or groove may also be placed on the mouthpiece proper. A raised line or ridge may also be used on a tab or mouthpiece. As mouthpieces vary in size the tab may have to be trimmed which is easily done. The tab would cover the upper surface of the mouthpiece and taper slightly outward from the tip.

4 Claims, 3 Drawing Sheets

MOUTHPIECE CORRECTION TAB

BACKGROUND OF THE INVENTION

The present invention relates to musical reed instrument mouthpieces and more particularly to an elongated tab placed on the top surface of the mouthpiece which will facilitate the proper distance that the mouthpiece goes into the players mouth. When playing a reed instrument the players teeth rest upon the upper surface of the instrument as they are not allowed to touch the lower reed of a musical instrument which vibrates to make the music. Thus, it is desirable to have a cushion on the upper surface and to further place markings on this cushion to allow for the proper placement of the teeth and thus the proper placement of the mouthpiece and reed in the players mouth. There are also modifications of the invention.

DESCRIPTION OF THE PRIOR ART

[An electronic search was done at Chester Fritz Library, University of North Dakota, Grand Forks, and nothing was found with the slightest relevance to the present invention. However the] The inventor has seen mouthpiece teeth cushions and as long as fifty years ago they used tire patches as mouthpiece teeth cushions.

SUMMARY OF THE PRESENT INVENTION

A primary object of the present invention is to provide an elongated tab on the top surface of mouthpieces of musical instruments namely the clarinets and the saxophones.

Another object of the invention is a tab that is made of suitable material such as plastic. This tab has [and has] an adhesive back covered with paper or plastic film to protect the adhesive. This back being removable [and can be removed] before the tab is applied to the mouthpiece.

A still further object of the invention is to have an indented line, groove or slot on the surface opposite the adhesive side. The tab would be contoured on one end so as to fit the contoured tip of the mouthpiece.

A still further object of the invention is an elongated tab which has a contoured end that is placed flush with the contoured tip of the mouthpiece, this tab would have an indented line, groove or slot, placed a distance from the contoured end of the tab. This indented line groove or slot would help the player place his teeth the proper distance from the tip of the mouthpiece. The tab being made of an easily bendable material would easily bend to fit the top curved surface on mouthpieces.

The inventor having been a musician and teacher most of his life knows the need for such an improvement especially for beginning students, as the mouth placement is critical for the beginner. It has also been discussed with several educators and they agree there is a need for a means to overcome this problem.

Other modifications include mouthpieces having an indented line or groove placed across the breadth of their upper surface during manufacture. Yet another modification would be the use of a raised ridge across the breadth of the upper surface of the mouthpiece proper or on the mouthpiece tab.

These and other objects and advantages of the present invention will become apparent with reference to the drawings, the description of the preferred embodiment and the appended claims.

DESCRIPTION OF THE PREFERRED EMBODIMENT

Figure 1:
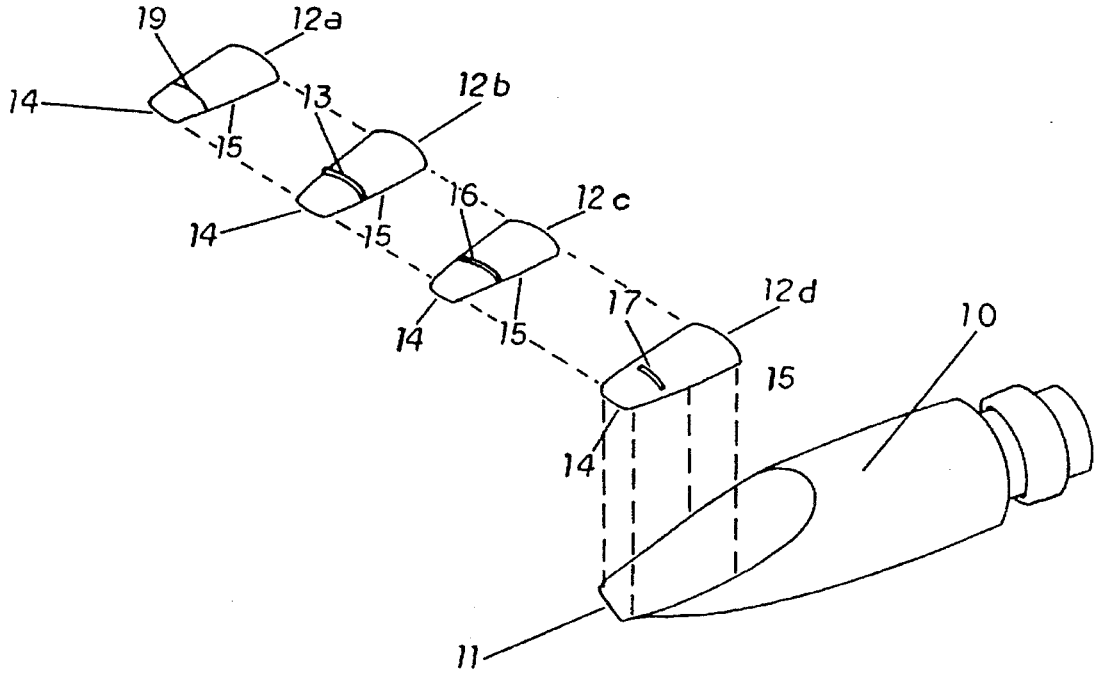
FIG. 1 is a perspective view showing various Mouthpiece Correction Tabs and their orientation on a mouthpiece.
Figure 1A:
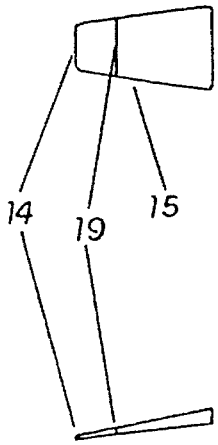
FIGS. 1*a*–1*d* show various Mouthpiece Correction Tabs in top elevation view with their corresponding side elevation view.
Figure 1B:
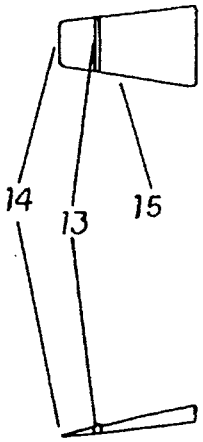
Figure 1C:
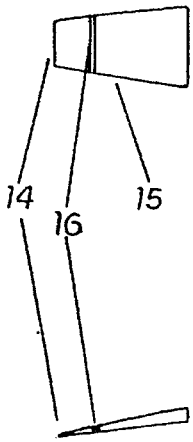
Figure 1D:
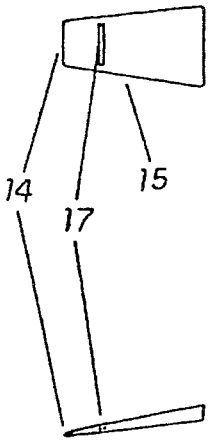

FIG. 1 numeral 10 illustrates a musical reed instrument mouthpiece. The numeral 11 shows a contoured end or tip of the mouthpiece. FIG. 1*a*–1*d* numerals 12*a*, 12*b*, 12*c*, and 12*d* show various embodiments of the mouthpiece control tab. Numeral 19 on tab 12*a* indicates an indented line which is cut a portion of the way through the tab and runs along the breadth of the tab. Numeral 13 on tab 12*b* shows a raised ridge running across the breadth of the tab. Numeral 16 on tab 12*c* indicates a groove, which requires removal of some of the material from the tab, this groove runs along the breadth of the tab. Numeral 17 on tab 12*d* indicates a slot where the tab material is completely removed except for the edges. Numeral 14 shows a contoured end of the tabs. Numeral 15 provides tapered edges slightly outward from the contoured end or tip.

Figure 2:
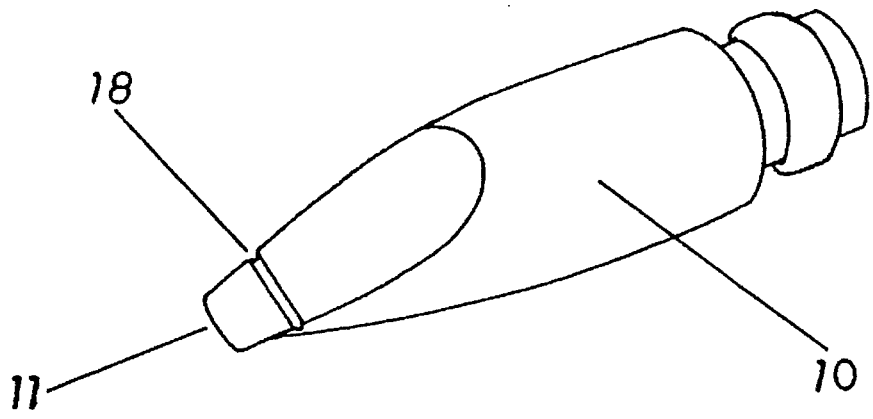
FIG. 2 is a perspective view of a musical reed instrument mouthpiece having a correction groove on the mouthpiece proper.
Figure 2A:
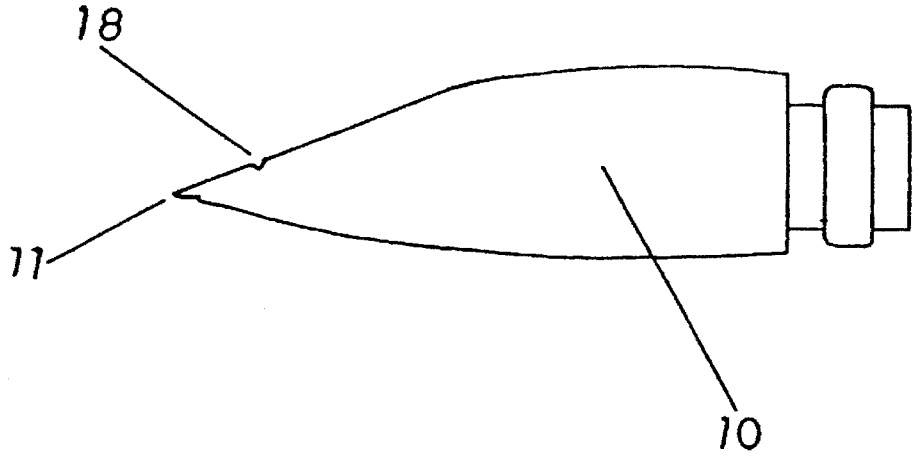
FIG. 2*a* is a side elevation view of a musical reed instrument mouthpiece having a correction groove on the mouthpiece proper.

FIGS. 2 and 2*a* numeral 10 illustrates a musical reed instrument mouthpiece, numeral 11 shows a contoured end or tip of the mouthpiece. Numeral 18 shows an indented line or groove in the mouthpiece proper.

Figure 3:
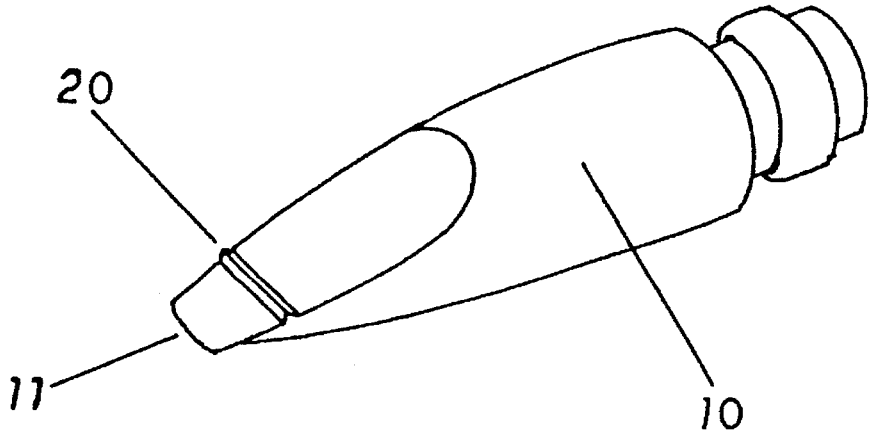
FIG. 3 is a perspective view of a musical reed instrument mouthpiece having a correction ridge on the mouthpiece proper.
Figure 3A:
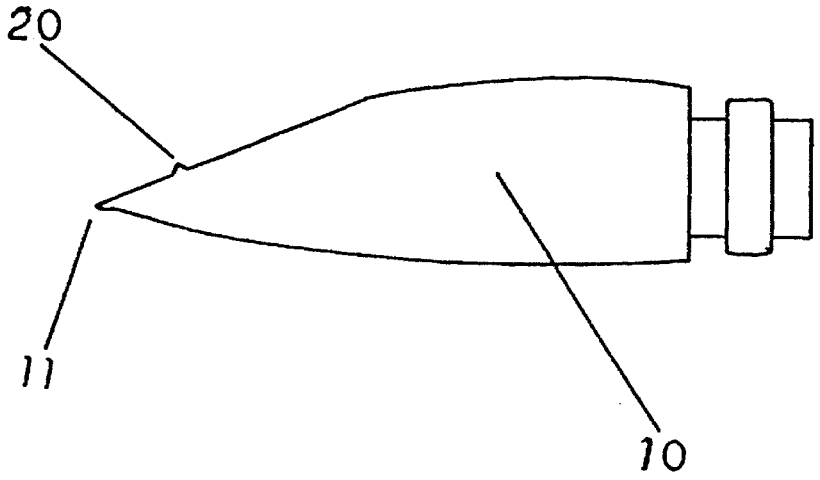
FIG. 3*a* is a side elevation view of a musical reed instrument mouthpiece having a correction ridge on the mouthpiece proper.

FIGS. 3 and 3*a* numeral 10 illustrates a musical reed instrument mouthpiece, numeral 11 shows a contoured end or tip of the mouthpiece Numeral 20 shows a raised line or ridge on the mouthpiece proper.

Referring in detail to the drawings FIGS. 1 and 1*a*–1*d* numerals 12*a*, 12*b*, 12*c* and 12*d* show four embodiments of the mouthpiece control tab. These tabs would also include an adhesive back for placement on the reed instrument mouthpiece The various embodiments demonstrate the use of a ridge, an indented line, a groove and slot. Use of these different embodiments would depend on the taste of the individual user.

I claim:

1. A reed instrument mouthpiece correction tab, said tab being elongated with a contoured end and a slight taper outward from said contoured end.

2. A reed instrument mouthpiece correction tab as recited in claim 1, wherein said tab includes at least one of the following, an indented line, groove, slot, or raised ridge across the breadth of its upper surface.

3. A reed instrument mouthpiece correction tab as recited in claim 2, wherein said tab has an adhesive back.

4. A reed instrument mouthpiece correction tab wherein said tab has an adhesive backing and one or more of the following, an indented line, groove, slot, or raised ridge across the breadth of its upper surface.

* * * * *